United States Patent [19]

Stielper

[11] 4,244,406

[45] Jan. 13, 1981

[54] SAFETY SWITCH FOR PORTABLE POWER-OPERATED DEVICE

[75] Inventor: Henry J. Stielper, White Hall, Md.

[73] Assignee: The Black & Decker Manufacturing Co., Towson, Md.

[21] Appl. No.: 958,370

[22] Filed: Nov. 7, 1978

[51] Int. Cl.[3] ..... B27C 5/10

[52] U.S. Cl. ..... 144/136 C; 83/DIG. 1; 144/134 D; 200/157; 200/334; 408/710

[58] Field of Search ..... 200/42 R, 42 T, 157, 200/321-326, 334, 61.85, 850, 61.58 R; 144/134 D, 136 C; 90/12 D, DIG. 3; 83/DIG. 1; 310/50, 68 A, 68 B; 407/710; 409/182

[56] References Cited

U.S. PATENT DOCUMENTS

| | | | |
|---|---|---|---|
| 2,897,302 | 7/1959 | Godfrey et al. | 200/42 R |
| 3,363,510 | 1/1968 | Burrows et al. | 144/136 C X |
| 3,379,852 | 4/1968 | Korshak | 200/322 X |
| 3,443,479 | 5/1969 | Hawley et al. | 144/136 C X |
| 3,447,001 | 5/1969 | Zelik | 310/50 |
| 3,511,947 | 5/1970 | Elkermann et al. | 200/42 |
| 3,767,876 | 10/1973 | Batson | 200/157 |
| 3,780,246 | 12/1973 | Beckering et al. | 200/322 X |
| 3,950,625 | 4/1976 | Klebe, Jr. et al. | 408/710 X |
| 4,033,077 | 7/1977 | Chester et al. | 310/68 B |
| 4,078,589 | 3/1978 | Miller | 310/68 A X |

*Primary Examiner*—Stephen Marcus

[57] ABSTRACT

A portable electric router including a housing enclosing an electric motor, and having a router bit extending from one end of the housing and driven by the motor. A router base assembly includes handles and a flat base plate and is adjustably fixed to the housing. The flat plate supports the router for movement along a work surface and is provided with a central opening through which the router bit extends to engage and penetrate the work surface. The other end of the housing has a support surface upon which the router can rest when the router is temporarily put down during use and when it is stored, or while the bit is changed, or while the base assembly is adjusted relative to the housing for depth adjustment of the bit. A switch is provided on the housing for turning the router motor "on" and "off", and is controlled by a switch operator having a portion which extends through an opening in the router housing support surface. The switch operator has one portion which extends beyond the support surface when the electric motor is "on", and is positioned flush with that surface when the motor is "off" so that the motor is "off" and cannot be turned "on" when the router is supported on its support surface. The switch operator has another portion rigidly connected to the one portion and which is at the side of the router housing and close to one of the handles for turning the motor "on" and "off".

11 Claims, 4 Drawing Figures

SAFETY SWITCH FOR PORTABLE POWER-OPERATED DEVICE

FIELD OF THE INVENTION

This invention relates to a safe control switch for portable, power operated devices such as an electric router.

BACKGROUND OF THE INVENTION

The present invention finds use in portable, power operated devices which include a switch for turning the device "on" and "off". One such device is a router which is an electric power tool having a rotatable, motor driven bit and is used for milling out the surfaces of wood or metal and for trimming materials such as laminates. Routers usually include a base assembly including a flat base plate which is adapted to slide over the work surface being milled or trimmed, and the router bit extends past the base to penetrate or engage the work surface.

Because the router bit extends beyond the base plate, it is impractical to support the router on its base plate when not in use. Thus, routers are usually provided with a support surface at their end opposite the router bit upon which the router can rest when not in use such as when the user temporarily puts the router down during use, and when the router is stored.

In this "rest" position, the router bit extends upwardly. It is convenient to change the bit when the router is in this position. Also, the router base assembly is usually adjustable to adjust the penetration depth of the router bit and this also is conveniently carried out when the router is in the rest position.

Routers are very powerful, high speed tools often operating at speeds of 25,000 rpm or higher. Since the router sometimes remains plugged into an electric power source when placed in the rest position, it will be appreciated that it is important that the router motor not be accidentally turned "on", particularly when changing the router bit or adjusting the router base. Also, it is desirable that it be certain that the router turns "off" when it is temporarily placed in the rest position during use, and when changing thr router bit and performing depth adjustment. Finally, the router should be conveniently turned "on" when ready for use.

SUMMARY OF THE INVENTION

It is an objective of the present invention to provide a control means operating mechanism for use in and as part of a portable power operated device, which automatically turns the power means for the device "off" and renders it difficult if not impossible to turn the power means "on" when the device is supported upon a rigid support surface.

More particularly, this invention provides a safety switch operating mechanism for use in and as part of a portable power operated device such as an electric router, which automatically turns the router motor "off" and renders it virtually impossible to inadvertently or accidentally turn the motor "on" when the router is in the "rest" position. Thus, the likelihood that the router bit will inflict accidental damage or injury when the router is temporarily put down during use or when changing the bit or making a depth adjustment is greatly reduced. In addition, the switch operating mechanism is located and constructed for easy manual manipulation to turn the router motor "on" and "off" when the operator's hands are in proper position holding the router during use.

Additional objectives and advantages of the invention will be set forth in part in the description which follows, and in part will be obvious from the description, or may be learned by practice of the invention. The objectives and advantages of the invention may be realized and attained by means of the instrumentalities and combinations particularly pointed out in the appended claims.

To achieve the objectives and in accordance with the purpose of the invention, as embodied and broadly described herein, the present invention is an improvement in a portable electric router of the type having housing means enclosing an electric motor, electric switch means operable to turn the motor "on" and "off", a rotatable bit extending from the housing means and driven by the motor, a base assembly attached to the housing means and including means adjacent the tool bit for supporting and guiding the router with said tool bit engaging a work surface, the housing means having support means provided to support the router on a generally horizontal surface with the tool bit out of engagement with the horizontal surface. The invention comprises switch operator means accessible from outside the housing means for operating the switch means for turning the router motor "off" and for preventing said motor from being turned "on" when the router is positioned with the support means engaging a horizontal surface. The switch operator means is movable from a first position where the motor is "on", to a second position where the motor is "off", at least a portion of the switch operator means extending outwardly of the support means when in the first position, the switch operator means portion when in the second position being located toward the support means from its location when in the first position.

In another aspect, the present invention relates to a portable electric router comprising a housing enclosing an electric motor, a router bit extending from one end of the housing and driven by the motor, a base assembly adjustably connected to the housing and including a flat plate adapted to engage a work surface and movably support the router thereon, the base having an opening therethrough through which the router bit extends, the base and the housing being relatively adjustable to vary the penetration depth of the router bit into the work surface. The housing has a second end opposite the first end and adapted to support the router when changing the router bit or when adjusting the housing relative to the base. Switch means is provided for turning the electric motor "on" and "off". Switch operator means associated with said switch means also is provided and includes manually operable means movable from a first position where the motor is "on", to a second position where the motor is "off", the manually operable means having a portion which extends outwardly of the housing second end when in the first position and which is substantially coplanar with the outermost portion of the housing second end when in the second position.

In yet another aspect, the present invention relates to a portable power operated device including a housing having power means therein, implement means extending outwardly of the housing and operated by the power means, control means on the housing for the power means, the control means including manual means movable from a first or "on" position in which the implement means is operative, to a second or "off" position where the implement means is inoperative. The device has support means rigid with the housing for supporting the device upon a rigid support means when the device is not in use. The manual means includes means for turning the power means "off" and preventing it from being turned "on" when the device is supported upon the rigid support means, the manual means extending outwardly of the support means on the device when in the first or "on" position, the manual means being substantially coplanar with the support means on the device when in the second or "off" position.

The accompanying drawings which are incorporated in and constitute a part of this specification, illustrate one embodiment of the invention and, together with the description, serve to explain the principles of the invention.

DESCRIPTION OF THE PREFERRED EMBODIMENT

Reference will now be made in detail to the present preferred embodiment of the invention, an example of which is illustrated in the accompanying drawings.

Figure 1:
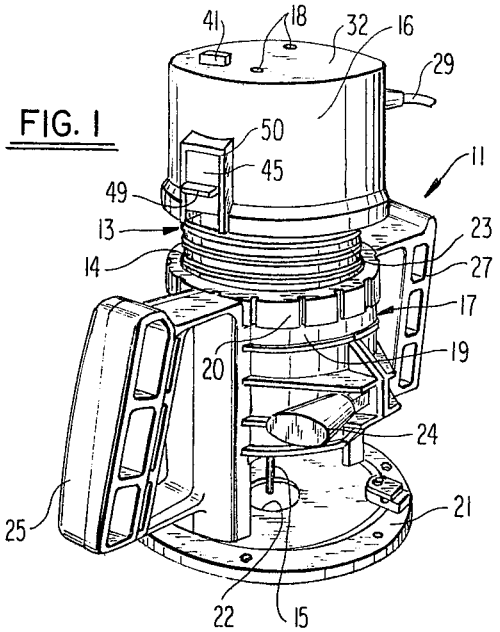
FIG. 1 is a perspective view showing a preferred form of portable electric router embodying the principles of the present invention.

The preferred embodiment of this invention is shown in FIG. 1 and is in and a part of a portable power operated device. As here embodied, this device is an electric router illustrated generally at 11 which includes a housing means 13 adjustably connected to a base assembly 17. The housing means 13 includes a motor housing 14 having a detachable end cap 16 fixed thereto by screws 18.

Power means is disposed within the motor housing 14 and is coupled to implement means. As here embodied, the power means is an electric motor (not shown) which is coupled to a router bit 15 by a suitable chuck or collet (not shown).

Figure 2:
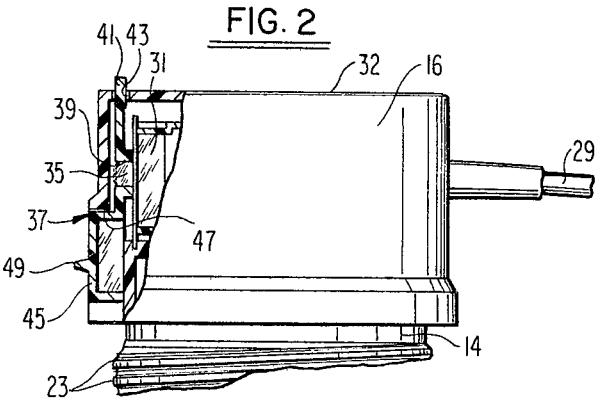
FIG. 2 is an enlarged view of a portion of FIG. 1 partly broken away and in section.

A router having a representative electric motor and collet is illustrated in Blevins U.S. Pat. No. 3,489,191 and is incorporated by reference herein. The motor may be powered from a suitable electric source connected thereto by a line cord 29. As shown in FIG. 2, control means including an electric switch 31 having a slider button 35, is positioned within the end cap 16 and controls "on" and "off" operation of the motor.

The motor housing 14 is generally cylindrical and is formed with integral external screw threads 23. The base assembly 17 has a cylindrical portion 19 which surrounds the motor housing 14. A ring 20 is provided with internal screw threads which engage threads 23 on the motor housing 14. Thus, by turning the ring 20 relative to the motor housing, the housing means 13 is adjusted longitudinally relative to the base assembly 17. The cylindrical portion 19 is split and is adapted to be drawn tightly into locking engagement with the screw threads 23 on motor housing 14 by a manually operable knob 24.

The base assembly 17 also includes a flat plate 21 which is adapted to rest upon a work surface and supports the router 11 for movement therealong. The base plate 21 is formed with an aperture 22 through which the router bit 15 extends for engagement with the work surface. Thus, by selective adjustment of the housing means 13 relative to the base assembly 17, the depth of penetration of the router bit 15 into the work surface is adjusted. The base assembly 17 also includes handles 25, 27 for manual control and manipulation of the router 11.

As described briefly above, the router 11 is used by sliding the base plate 21 along a work surface while the rotating router bit 15 engages and penetrates that surface. The router bit 15 extends through opening 22 in the base plate 21 and necessarily beyond the lower surface of the plate 21. For this reason, the router 11 cannot be conveniently set down on a surface for temporary nonuse, or stored when not in use by resting it on the base plate 21.

Thus, it is conventional to construct the end of the housing means 13 opposite the router bit with a support means so that the router can be stored upside down on a surface. To that end, end cap 16 of housing means 13 has a generally flat surface 32 so that router 11 can be set down during use and stored on a rigid support means such as a generally horizontal surface 34 by turning the router 11 upside down and placing end cap support surface 32 against surface 34 (see FIG. 4). It is also conventional to change router bits and to make depth adjustments when the router is upside down in the rest position.

It will be appreciated that many times when the router is inverted and placed in the rest position on a surface 34, the line cord 29 remains plugged into an electric source. For safety reasons the motor must be "off". It will also be appreciated that desirably it should be impossible to accidentally turn the router back "on" when it is in the rest position, especially while the user is changing the bit or making a depth adjustment. Consequently, it is desirable then that the router motor be turned "off" automatically and that it be prevented from being turned "on" when the router is in the rest position. This is true not only while the bit is being changed and during depth adjustment, but also when the router is simply set down during temporary nonuse.

In accordance with the invention, the switch 31 is operated by manual means which insures that the router motor is "off" and prevents it from being turned "on" when the router is placed in the rest position. As here embodied, and shown in FIG. 2, the manual means comprises switch operator means including a rigid elongated slider extension 37 disposed within the end cap 16 and formed with an aperture 39 snugly receiving the slider button 35. The slider extension 37 has a first portion 41 which extends through an opening 43 in the end cap 16, and has a second portion 45 connected to the first portion 41 for conjoint movement therewith and spaced therefrom and located in a lateral slot 47 in the end cap 16. The second portion 45 of slider extension 37 has a projection 49 which is located for convenient finger engagement when the user has his hands on the handles 25, 27. The end cap 16 is formed with an outward extension 50 around lateral slot 47 which protects the slider extension second portion 45.

Figure 3:
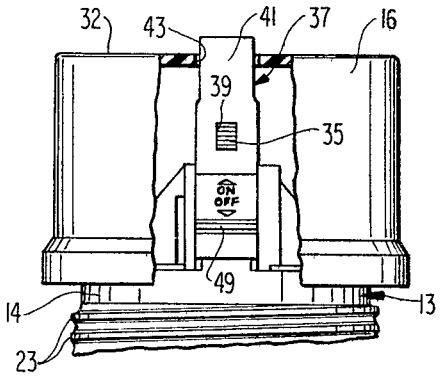
FIG. 3 is a side view of FIG. 2.

The switch slider button 35 is moved to turn the router electric motor "on" by upward movement of the slider extension 37 as seen in FIGS. 1–3. In this "on" position, the first portion 41 of the slider extension 37 extends outwardly beyond the support surface 32 of the end cap 16. Movement of the slider extension 37 into this "on" position is accomplished by upward finger pressure on the projection 49.

When it is desired to turn the electric motor "off", the slider extension 37 is moved downwardly from the position shown in FIGS. 1–3 moving the outer end of the first portion 41 toward the cap support surface 32. This is achieved either by downward pressure on the first portion 41 or downward pressure on projection 49.

Figure 4:
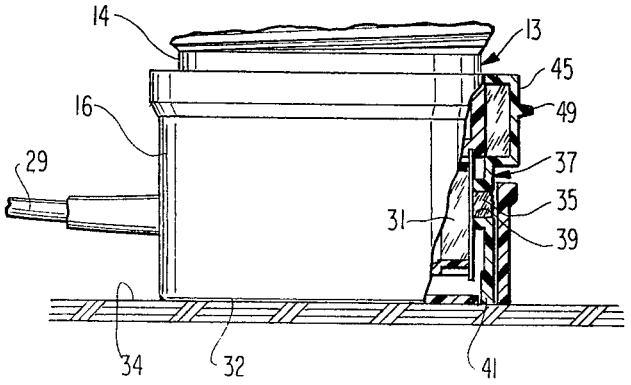
FIG. 4 is a view similar to FIG. 2 and showing the position of the parts when the router is in the "rest" position.

In accordance with the invention, the switch operator means is positioned relative to the router support surface 32 on end cap 16 to insure that the router motor is turned "off" and prevents it from being turned "on" when the router is placed in the rest position. As here embodied, the first portion 41 of the slider extension 37 extends beyond the support surface 32 of the housing end cap 16 when the switch slider 35 is positioned to turn the electric motor "on". If the electric motor is still "on" when the router 11 is inverted and the support surface 32 of housing end cap 16 placed against surface 34, the slider extension 37 is pushed inwardly of the housing end cap 16 such that the first portion 41 is coplanar with the support surface 32. Movement of the extension 37 causes the switch slider 35 to move to a position to turn the router motor "off". The position of the parts when the router 11 is inverted and stored on a surface, the "rest" position, is shown in FIG. 4.

Furthermore, as long as the router is in the rest position, the weight of the router 11 acting on the slider extension 37 insures that the motor will not accidentally be turned "on" even if the user accidentally engages the second portion 45 of the slider extension 37. When it is desired to turn the motor back "on" for further use of the router, the user simply places his hands on the handles 25, 27 and lifts the router 11 from the surface 34, inverts the router to the upright position, and aplies upward pressure to the projection 49 on the slider extension 37 with his thumb.

It will be apparent to those skilled in the art that various additions, substitutions, modifications, and omissions can be made in the present invention without departing from the scope or spirit of the invention. Thus, it is intended that the present invention cover the additions, substitutions, modifications, and omissions provided that they come within the scope of the appended claims and their equivalents.

What is claimed is:

1. In a portable electric router of the type having housing means enclosing an electric motor, electric switch means operable to turn said motor "on" and "off", a rotatable tool bit extending from said housing means and driven by said motor, a base assembly attached to said housing means and including means adjacent said tool bit for supporting and guiding said router with said tool bit engaging a work surface, said housing means having support means to support said router on a generally horizontal surface with said tool bit out of engagement with said horizontal surface; the improvement which comprises switch operator means accessible from outside said housing means for operating said switch means and for turning said motor "off" and for preventing said motor from being turned "on" when said router is positioned with said support means engaging a horizontal surface, said switch operator means being movable from a first position where said motor is "on", to a second position where said motor is "off", at least a portion of said switch operator means extending outwardly of said support means when in said first position, said switch operator means portion when in said second position being located toward said support means from its location when in said first position.

2. In a portable electric router of the type having housing means enclosing an electric motor, electric switch means operable to turn said motor "on" and "off", a rotatable tool bit extending from said housing means and driven by said motor, a base assembly attached to said housing means and adjacent said tool bit for supporting and guiding said router with said tool bit engaging a work surface, said housing means having support means provided to support said router on a generally horizontal surface with said tool bit out of engagement with said horizontal surface; the improvement which comprises switch operator means accessible from outside said housing means for operating said switch means, said switch operator means including means for turning said router motor "off" and preventing said motor from being turned "on" when said router is positioned with said support means engaging a horizontal surface, said switch operator means being movable from a first position where said motor is "on", to a second position where said motor is "off", said switch operator means having a first portion extending outwardly of said support means when in said first position, said switch operator means first portion being substantially coplanar with said suport means when in said second position, said switch operator means having a second portion connected to said first portion for conjoint movement therewith and spaced therefrom and from said support means for turning said motor "on" and "off".

3. In a portable electric router of the type having housing means enclosing an electric motor, electric switch means operable to turn said motor "on" and "off", a rotatable tool bit extending from said housing means and driven by said motor, a base assembly attached to said housing means and adjacent said tool bit for supporting and guiding said router with said tool bit engaging a work surface, said housing means having a relatively flat end opposite said tool bit and provided to support said router on a generally horizontal surface with said tool bit out of engagement with said horizontal surface; the improvement which comprises switch operator means accessible from outside said housing means for operating said switch means, said switch operator means including means for turning said router motor "off" and preventing it from being turned "on" when said router is positioned with said flat end engaging a horizontal surface, said switch operator means being meovable from a first position where said motor is "on", to a second positon where said motor is "off", said switch operator means having at least a portion entending outwardly of said housing means flat end when in said first position, said switch operator means portion being substantially coplanar with said housing means flat end when in said second position.

4. A portable electric router comprising a housing enclosing an electric motor, a router bit extending from one end of said housing and driven by said motor, a base assembly adjustably connected to said housing and including a flat plate adapted to engage a work surface and movably support said router thereon, said base having an opening through which said router bit extends, said base and said housing being relatively adjustable to enable variation of the penetration depth of said router bit into said work surface, said housing having a second end opposite and first end and adapted to support said router when changing said router bit or when adjusting said housing relative to said base, switch means for turning said electric motor "on" and "off", switch operator means associated with said switch means and including manually operable means movable from a first position where said motor is "on", to a second position where said motor is "off", said manually operable means having a portion which extends outwardly of said housing second end when in said first position and which is substantially coplanar with the outermost portion of said housing second end when in said second position.

5. A portable power operated device including a housing having power means therein, implement means extending outwardly of said housing and operated by said power means, control means on said housing for said power means, said control means including manual means movable from a first or "on" position in which said implement means is operative, to a second or "off" position where said implement means is inoperative, said device having support means rigid with said housing for supporting said device upon a rigid support means when said device is not in use, said manual means including means for turning said power means "off" in response to supporting the support means of said device upon said rigid support means and preventing it from being turned "on" when said device is supported upon said rigid support means, said manual means extending outwardly of said support means on said device when in said first or "on" position, said manual means being substantially coplanar with said support means on said device when in said second or "off" position.

6. A portable power operated device including a housing having power means therein, implement means extending outwardly of said housing and operated by said power means, control means on said housing for said power means, said control means including manual means movable from a first or "on" position in which said implement means is operaive, to a second or "off" position where said implement means is inoperative, said device having support means rigid with said housing for supporting said device upon a rigid support means when said device is not in use, said manual means including means for turning said power means "off" and for preventing said power means from being turned "on" when said device is supported upon said rigid support means, said manual means having a first portion extending outwardly of said support means on said device when in said first or "on" position, said manual means first portion being substantially coplanar with said support means on said device when in said second or "off" position, said manual means having a second portion connected to said first portion for conjoint movement therewith and spaced therefrom, and accessible from outside said housing for "on" and "off" operation of said device.

7. In a portable electric router of the type having a housing enclosing an electric motor, a cap fixed to said housing, electric switch means in said cap and operable to turn said motor "on" and "off", a rotatable tool bit extending from said housing and driven by said motor, a base assembly attached to said housing and including means adjacent said tool bit for supporting and guiding said rounter with said tool bit engaging a work surface, said cap having an end portion formed to support said router on a generally horizontal surface with said tool bit out of engagement with said horizontal surface; the improvement which comprises switch operator means movably disposed within said cap and accessible from outside said cap for operating said switch means and for turning said router motor "off" and for preventing said motor from being turned "on" when said router is positioned with said cap end portion engaging a horizontal surface, said switch operator means being movable from a first position where said motor is "on", to a second position where said motor is "off", at least a portion of said switch operator means extending outwardly of said cap end portion when in said first position, said switch operator means portion being substantially coplanar with said cap end portion when in said second position.

8. In a portable electric router of the type having a housing enclosing an electric motor, a cap fixed to said housing, electric switch means in said cap and having a slider button operable to turn said motor "on" and "off", a rotatable tool bit extending from said housing and driven by said motor, a base assembly attached to said housing and including means adjacent said tool bit for supporting and guiding said router with said tool bit engaging a work surface, handle means for manipulating said router, said cap having an end portion formed to support said router on a generally horizontal surface with said tool bit out of engagement with said horizontal surface; the improvement which comprises switch operator means movably disposed within said cap and accessible from outside said cap for operating said switch means, said switch operator means including means for turning said router motor "off" and for preventing said router motor from being turned "on" when said router is positioned with said cap end portion engaging a surface, said switch operator means including a rigid elongated slider extension interconnected with said slider button and movable from a first position where said motor is "on", to a second position where said motor is "off", said slider extension having a first portion extending outwardly of said cap end portion when in said first position, said slider extension first portion being substantially coplanar with said cap end portion when in said second position, said slider extension having a second portion positioned in an opening in said cap and convenient to said handle means for turning said router motor "on" and "off" while a user has at least one hand on said handle means.

9. A portable electric router comprising a housing enclosing an electric motor, a router bit extending from the bottom of said housing and driven by said motor, a base assembly connected to said housing and including a flat plate adapted to engage a work surface and movably support said router thereon, said base having an opening through which said router bit extends, said housing having a top adapted to support the weight of said router on a horizontal surface when changing said router bit, switch means for turning said electric motor "on" and "off", switch operator means associated with said switch means and including manually operable means movable from a first position where said motor is "on", to a second position where said motor is "off", said manually operable means having a portion which extends outwardly of said housing top when in said first position and which moves toward said housing top under the weight of said router when it is placed with its top against a horizontal surface, said manually operable means portion being substantially coplanar with the outermost portion of said housing top when in said second position.

10. In a portable electric router of the type having a housing enclosing an electric motor, electric switch means in said housing and operable to turn said motor "on" and "off", a rotatable tool bit extending from said housing and driven by said motor, a base assembly attached to said housing and including means adjacent said tool bit for supporting and guiding said router with said tool bit engaging a work surface, said housing having an end portion formed to support said router on a generally horizontal surface with said tool bit out of engagement with said horizontal surface; the improvment which comprises switch operator means movably disposed within said housing and accessible from outside said housing for operating said switch means and for turning said router motor "off" and for preventing said motor from being turned "on" when said router is positioned with said end portion engaging a horizontal surface, said switch operator means being movable from a first position where said motor is "on", to a second position where said motor is "off", said switch operator means includihg a portion extending through an opening in said housing end portion and outwardly thereof when in said first position, said switch operator means portion being substantially coplanar with said housing end portion when in said second position.

11. In a portable electric router of the type having a housing enclosing an electric motor, a cap fixed to said housing, electric switch means in said cap and having a slider button operable to turn said motor "on" and "off", a rotatable tool bit extending from said housing and driven by said motor, a base assembly attached to said housing and including means adjacent said tool bit for supporting and guiding said router with said tool bit engaging a work surface, handle means for manipulating said router, said cap having an end portion formed to support said router on a generally horizontal surface with said tool bit out of engagement with said horizontal surface; the improvement which comprises switch operator means movably disposed within said cap and accessible from outside said cap for operating said switch means, said switch operator means including means for turning said router motor "off" and for preventing said router motor from being turned "on" when said router is positioned with said cap end portion engaging a surface, said switch operator means including a rigid elongated slider entension formed with an aperture receiving said slider button and movable from a first position where said motor is "on", to a second position where said motor is "off", said slider extension having a first portion extending through an aperture in and outwardly of said cap end portion when in said first position, said slider extension first portion being substantially coplanar with said cap end portion when in said second position, said slider extension having a second portion positioned in an opening in the side of said cap and adjacent to said handle means for turning said router motor "on" and "off" while a user has at least one hand on said handle means.

* * * * *

UNITED STATES PATENT AND TRADEMARK OFFICE

CERTIFICATE OF CORRECTION

PATENT NO. : 4,244,406

DATED : January 13, 1981

INVENTOR(S) : Henry J. Stielper

It is certified that error appears in the above—identified patent and that said Letters Patent is hereby corrected as shown below:

Column 6, line 54, change "meovable" to --movable--;

Column 6, line 56, change "entend-" to --extend- --;

Column 7, line 3, change "and" first occurrence to --said--;

Column 7, line 67, change "rounter" to --router--;

Column 9, line 23, change "includihg" to --including--;

Column 10, line 18, change "entension" to --extension--.

Signed and Sealed this

Second Day of June 1981

[SEAL]

Attest:

RENE D. TEGTMEYER

Attesting Officer

Acting Commissioner of Patents and Trademarks